US007448115B2

(12) United States Patent
Howell et al.

(10) Patent No.: US 7,448,115 B2
(45) Date of Patent: Nov. 11, 2008

(54) MODULAR ATTACHMENT ASSEMBLY

(75) Inventors: Frank A. Howell, Oxford, ME (US); Justin Kiger, Harrison, ME (US)

(73) Assignee: Illinois Tool Works Inc., Glenview, IL (US)

( * ) Notice: Subject to any disclaimer, the term of this patent is extended or adjusted under 35 U.S.C. 154(b) by 352 days.

(21) Appl. No.: 11/392,168

(22) Filed: Mar. 29, 2006

(65) Prior Publication Data

US 2006/0191110 A1 Aug. 31, 2006

Related U.S. Application Data

(63) Continuation-in-part of application No. 11/037,682, filed on Jan. 18, 2005, now abandoned.

(51) Int. Cl.
*A45F 5/00* (2006.01)

(52) U.S. Cl. ..... 24/3.12; 24/700

(58) Field of Classification Search ..... 24/3.1, 24/3.3, 3.5, 3.7, 3.12, 593.1, 682.1, 695, 24/697.1, 698.7, 700–702, 442, 584.1, 586.1, 24/586.11; 2/94, 101, 102, 247, 251, 253; 224/182, 223, 603, 660, 901, 901.8; 40/603, 40/610

See application file for complete search history.

(56) References Cited

U.S. PATENT DOCUMENTS 2,965,939 A * 12/1960 Olsson ..... 24/3.7
4,222,595 A * 9/1980 Schmidt ..... 292/91
4,520,533 A * 6/1985 Kasai ..... 24/198
4,555,812 A * 12/1985 Akers ..... 2/94
4,760,980 A * 8/1988 Sharpe ..... 245/2
5,020,196 A * 6/1991 Panach et al. ..... 24/590.1
5,031,244 A * 7/1991 Inagaki ..... 2/102
5,604,958 A * 2/1997 Anscher ..... 24/3.1
5,617,587 A * 4/1997 Marchbanks ..... 2/247
5,724,707 A 3/1998 Kirk et al.
6,112,377 A * 9/2000 Wilson ..... 24/452
6,173,479 B1 1/2001 Howell
6,553,635 B1 4/2003 Howell et al.
6,708,379 B1 * 3/2004 Wilson ..... 24/452
6,726,075 B1 * 4/2004 Patel et al. ..... 224/582
6,874,163 B2 * 4/2005 Marshall ..... 2/102
2006/0096009 A1 * 5/2006 Carlson ..... 2/247

* cited by examiner

*Primary Examiner*—Robert J Sandy
*Assistant Examiner*—Ruth C Rodriguez
(74) *Attorney, Agent, or Firm*—Gauthier & Connors LLP

(57) ABSTRACT

A modular assembly for detachable securing an accessory component to a garment or the like, comprises a meshed fabric, with an array of first openings forming an integral part of the garment. A base plate and a locking plate are provided, the former being secured to the accessory component. A plurality of studs are provided on one of the plates, and a plurality of second openings are provided on the other of the plates. The plates are adapted to be positioned on opposite sides of the meshed fabric, with the studs on the one plate projecting through respective first openings in the meshed fabric and into interlocked engagement within the second openings of the other plate.

26 Claims, 5 Drawing Sheets

MODULAR ATTACHMENT ASSEMBLY

CROSS REFERENCE TO RELATED APPLICATION

This application is a continuation-in-part of U.S. application Ser. No. 11/037,682 filed Jan. 18, 2005 now abandoned.

TECHNICAL FIELD

The present invention relates to the attachment of accessory components to garments, harnesses, and the like, and, more particularly, to a modular assembly designed to removably attach pockets, pouches, or the like, to mesh fabrics comprising integral parts of such garments and harnesses.

BACKGROUND

Many types of load bearing garments or backpacks may employ some type of attachment system for accessories so that a user may locate any of a variety of such accessories (e.g., pockets, pouches, and holders) where they will be conveniently accessible. Permanently attached pockets are suboptimal because they require extensive repair or replacement of the garment when they wear out. Pockets that are permanently attached cannot be repositioned for the comfort and accessibility of the individual user, nor exchanged for more appropriate alternative accessories given the current use.

Well known attachment systems include keepers with slides, hook and loop fasteners, snap fasteners (both hard and soft), buttons, and interlocking straps. Generally, the problems associated with these systems are the labor and expense, weight, heat stress on the user, unreliability, bulk, lack of comfort, and creation of unstable loads due to sloppiness in the fitting.

Keepers and sliders tend to be uncomfortable to the user, or require padding, which adds to a user's heat stress. Their mechanisms have a tendency to become fouled, and are costly to repair when damaged.

Hook and loop fasteners (of both plastic and metal) are noisy and become unreliable when exposed to adverse environmental conditions, such as water, grit, mud, snow, or ice.

Snap fasteners are unreliable, easily damaged, and require support to engage. These fasteners require both sides of the snap to be affixed to heavy textile substrates and do not provide enough retention for high load situations.

Some other attachment methods employ one or more plastic parts, which are adhered directly to the garment or the pocket, and interface with another part on the opposing surface. These plastic parts are sewn directly onto a textile surface, but this requires that a relatively low strength plastic be used and that it be thinned to allow penetration by a sewing needle. Furthermore, piercing the plastic in this manner damages it precisely at the point of greatest load, typically resulting in tear-outs during heavy use.

Modular pockets are frequently avoided due to the cost and lack of stability caused by sloppiness in the attachment. Methods which can better approximate the stability of permanent attachment, such as the interlocking straps described in U.S. Pat. No. 5,724,707, may be expensive, bulky, and cause heat stress due to their thickness and heavier textile substrates required on a garment for their mounting. An interlocking strap system confines the location and angle at which modular pockets can be attached to a garment, based on the width and placement of the straps on the garment.

SUMMARY OF THE INVENTION

The modular assembly of the present invention allows a user to customize the number, style, and location of the accessory components on worn or carried items. The ability to mount accessory components at various positions and orientations enhances the utility of both the accessory components and the garment. Further advantages are derived from a system that uses a mesh textile as the substrate for accessory attachment. When employed as a structural element in a garment or carrier, a mesh textile has advantages in weight reduction as well as in the reduction of heat stress in warm weather environments. To be useful in performance applications, such as load bearing garments, backpacks, sportsman's gear, or luggage, an attachment system must have substantial retention of what is attached.

Objectives of the present invention include the provision of a secure, reliable, robust, and easy to use attachment system that is low in profile (i.e., flat against the garment or item), and that allows accessory components to be mounted in a variety of positions and orientations.

In accordance with one aspect of the present invention, a modular assembly for detachably securing an accessory component to a garment or the like includes a meshed fabric forming an integral part of the garment. The meshed fabric has an array of first openings. A base plate has a plurality apertures formed as second openings communicating with narrower slots bordered by side ledges. The base plate is adapted to be secured to the accessory component as by stitching, and to be positioned on one side of the meshed fabric with its second openings aligned with mating first openings in the fabric. A locking plate has a plurality of studs and is adapted to be positioned on an opposite side of the meshed fabric with the studs projecting through the mating first openings into the second openings and into interlocked engagement with the base plate.

In accordance with another aspect of the present invention, the arrangement of the second openings and studs is reversed, i.e. the studs are located on the base plate and the second openings are located in the locking plate.

In other aspects of the present invention, the accessory component is comprised at least partially of a fabric to which the base plate is secured by stitching. The base plate is additionally provided with third openings spaced along stitching paths parallel to and on opposite sides of its longitudinal axis, the third openings being arranged to accept a threaded needle of a sewing machine employed to stitch the base plate to the fabric. The base plate is additionally provided with guide surfaces for guiding the sewing machine along the stitching paths.

The second openings are relatively large in comparison to the width of the slots. The studs have heads that are connected to either the base plate or locking plate, as the case may be, by stems. The heads are wider than the space between the side ledges of the slots and are configured and dimensioned to enter the second openings in a first direction. The stems have widths that are narrower than the heads and dimensioned to enter the slots in a second direction perpendicular to the first direction. This places the heads in an overlapping relationship with the side ledges of the slots to establish the interlocked engagement between the locking plate and base plate.

A top surface of the base plate is provided with grooves extending between the third openings. The stitching is recessed beneath said top surface in the grooves. These and other features and advantages of the present invention will now be described in further detail with reference to the accompanying drawings, wherein:

DETAILED DESCRIPTION

Figure 1:
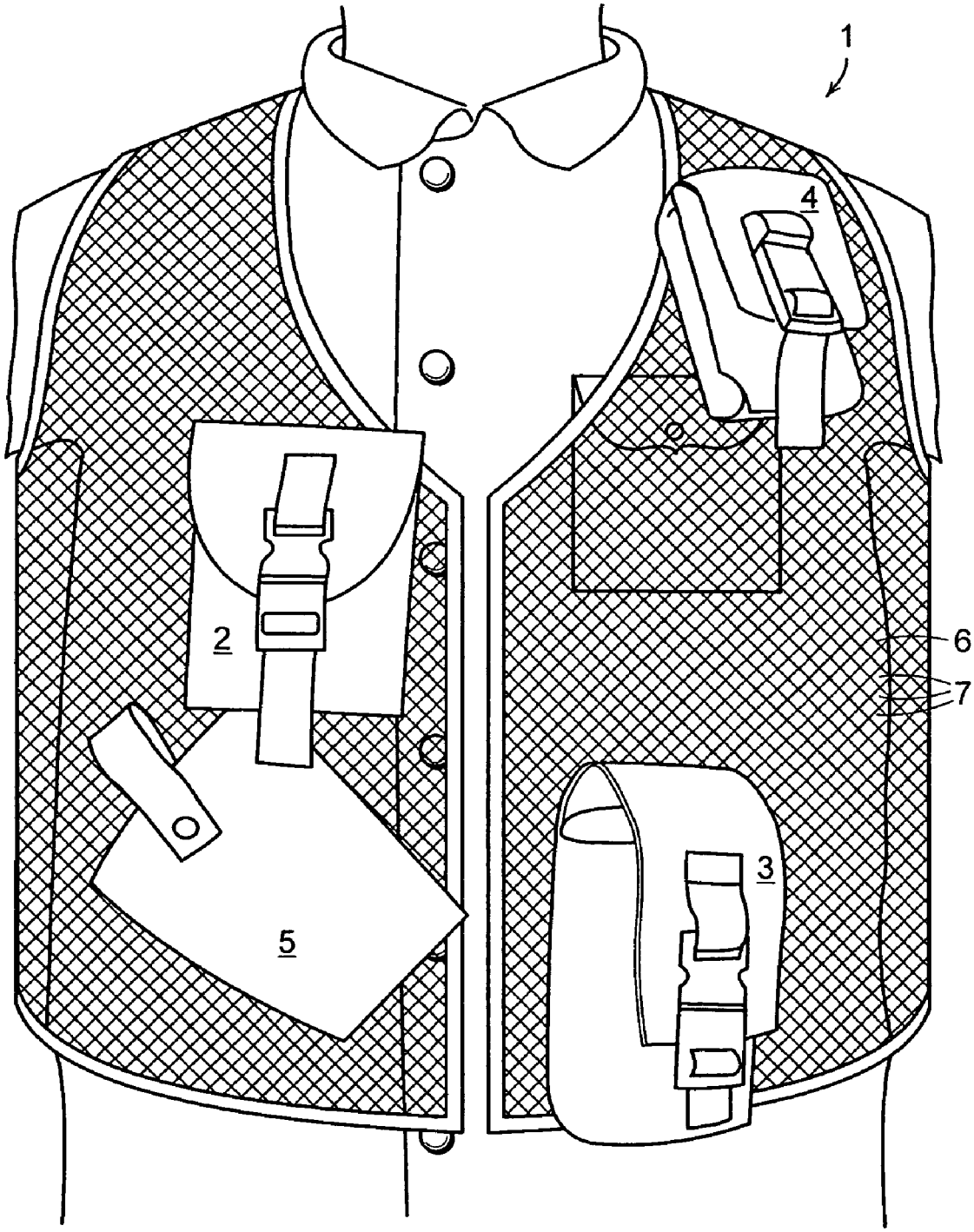
FIG. 1 is a front view of a vest having several accessory components removably attached thereto.
Figure 3:
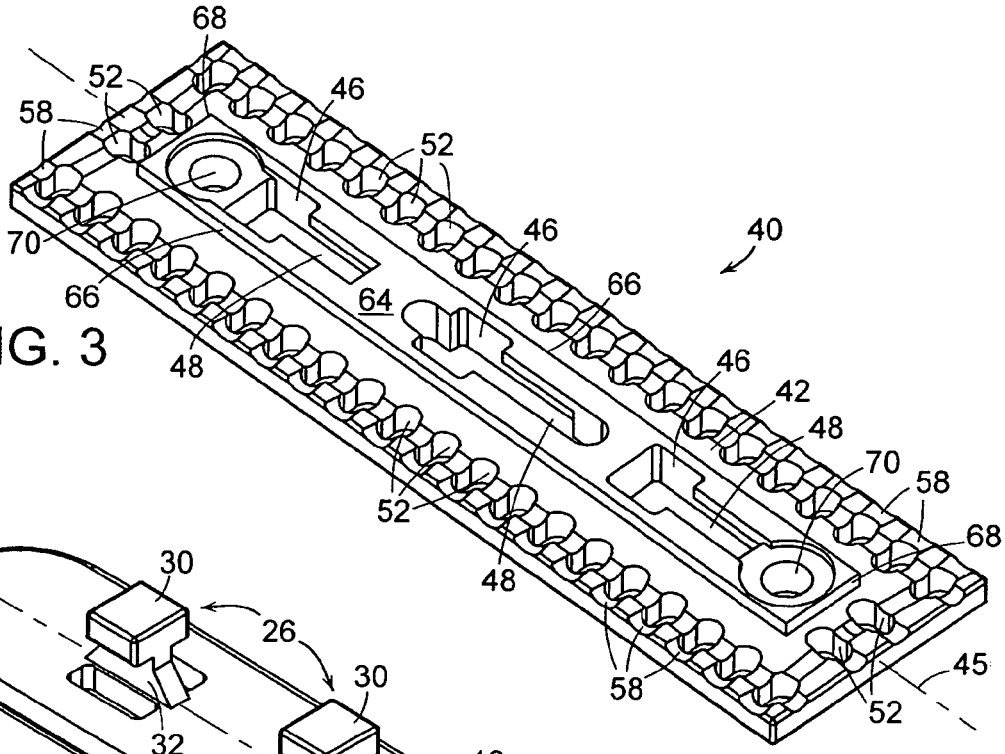
FIG. 3 is an isometric view of one embodiment of a base plate.
Figure 2:
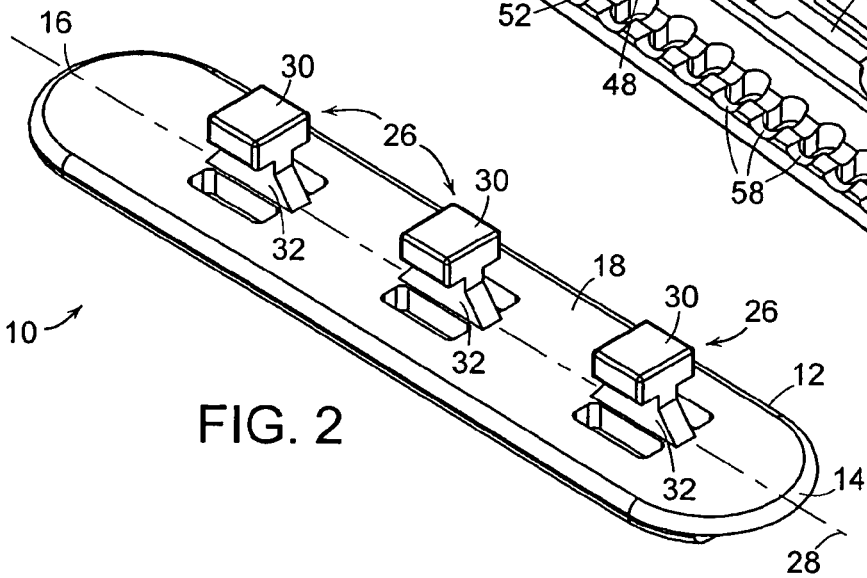
FIG. 2 is an isometric view of one embodiment of a locking plate.

Referring to FIG. 1, vest 1 is shown having various accessory components attached to it, including a pocket 2, pouch 3, ammunition pocket 4, and pistol holster 5. The accessory components are located on and removably attached to the vest by modular assemblies in accordance with the present invention. More particularly, a meshed fabric 6 having an array of first openings 7 is provided as an integral part of the vest 1. One or more base plates are attached to each accessory component. For each base plate, a locking plate is provided to interlock with the base plate and to trap the meshed fabric 6 of the vest 1 between the base plate and the locking plate. The accessory components may be attached at various selected positions and orientations to suit the wearer of the vest.

A non-limiting example of a mesh fabric 6 is that available from Crossfire Australia Pty Ltd., of Braidwood, NSW, Australia.

With reference additionally to FIGS. 2-9, a locking plate 10 is shown having a planar base 12 with ends 14 and 16, a top surface 18, and a bottom surface 20. Undercut recesses 22 and 24 are disposed on bottom surface 20 at ends 14 and 16 respectively. In one example, a user may engage recesses 22 and 24 with a lever or a tool, such as a flat-tipped screwdriver, to interlock or disengage locking plate 10 with a base plate, as described in more detail below. Locking plate 10 may be molded from any known plastic material, e.g., ABS or polycarbonate, and provided with a length of about 2.5 inches, a width of about 0.6 inches and a thickness of about 0.1 inches.

Studs 26 protrude from top surface 18 of base 12 and are disposed longitudinally along its longitudinal axis 28. The studs 26 have heads 30 connected to base 12 by stems 32 having a narrower width as compared to that of the heads 30. In one example, stems 32 are about half the width of heads 30. In another example, heads 30 have a width of about 0.25 inches, a length of about 0.25 inches, and a thickness of about 0.062 inches. Stems 32 have a width of about 0.125 inches, for example. Studs 26 may protrude about 0.2 inches from top surface 18, for example.

A base plate 40 has a top surface 42 and a bottom surface 44 and a longitudinal axis 45. Second openings 46 extend through base plate 40 and are arranged along longitudinal axis 45. Each opening 46 is sized to accommodate a head 30 on the studs 26 of locking plate 12. Elongated slots 48 extend through base plate 40 and each slot 48 is in communication with an opening 46. The slots 48 are bordered by side ledges 50. The space between the side ledges is wide enough to accommodate the stems 32 of the studs, yet narrow enough to be overlapped by the heads 30.

Third stitching holes 52 border the edges of the base plate 40. The holes 52 are sized to accommodate a sewing machine needle and are uniformly spaced so a sewing machine can be adjusted to the correct number of stitches per inch to correspond with spacing between holes 52. In one example, holes 52 are elongated transversely to the direction in which base plate 40 is sewn so that several different types of sewing machines may be used. Preferably, grooves 58 extend between individual holes 52, and between the holes and the edges of the base plate. The grooves 58 aid in locating stitches during sewing, and also protect the stitching thread from abrasion. The holes 52 allow the base plate to be molded of stronger, albeit more puncture resistant materials, because a sewing needle does not have to punch through base plate 40 to form each stitch.

Preferably, the top surface 42 of base plate 40 is formed with an elevated center portion 64 forming guide shoulders 66 parallel to axis 45 and guide shoulders 68 transverse to axis 45. Guide shoulders 66 and 68 guide a sewing machine foot during a stitching operation.

Additionally, rivet holes 70 may be provided to accommodate attachment of base plate 40 by commonly known riveting methods.

Figure 5:
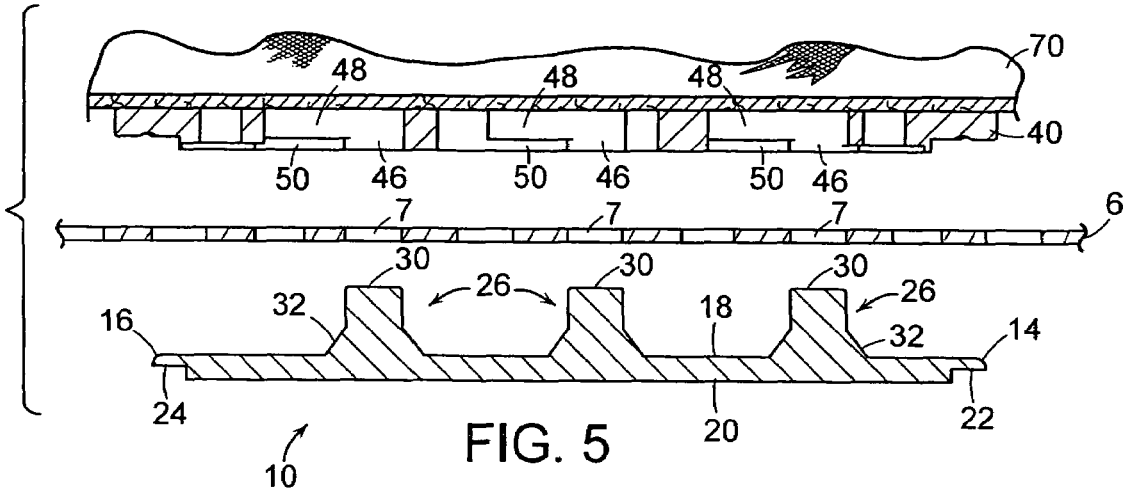
FIG. 5 is an exploded cross sectional view of a base plate, an accessory component, a mesh fabric, and a locking plate.

FIG. 5 illustrated the components of the modular assembly in a dissembled state. The base plate 40 is attached as by stitching (not shown) to an accessory component 70. The meshed fabric 6 is interposed between the base plate and the locking plate 10. The second openings 46 of the base plate and the studs 26 of the locking plate are in alignment with respective first openings 7 in the meshed fabric.

Figure 6:
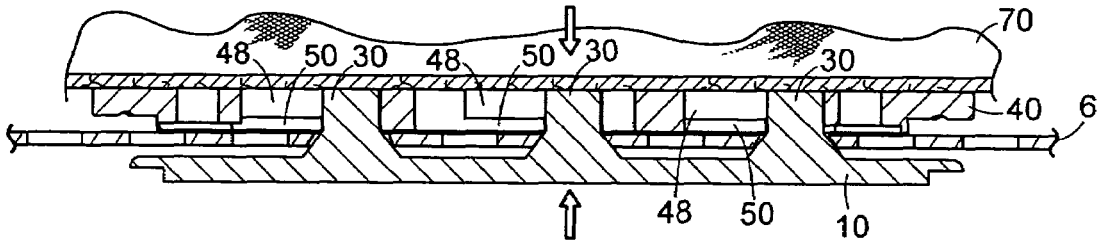
FIG. 6 is a sectional view showing the components of FIG. 5 in a partially assembled state.
Figure 8:
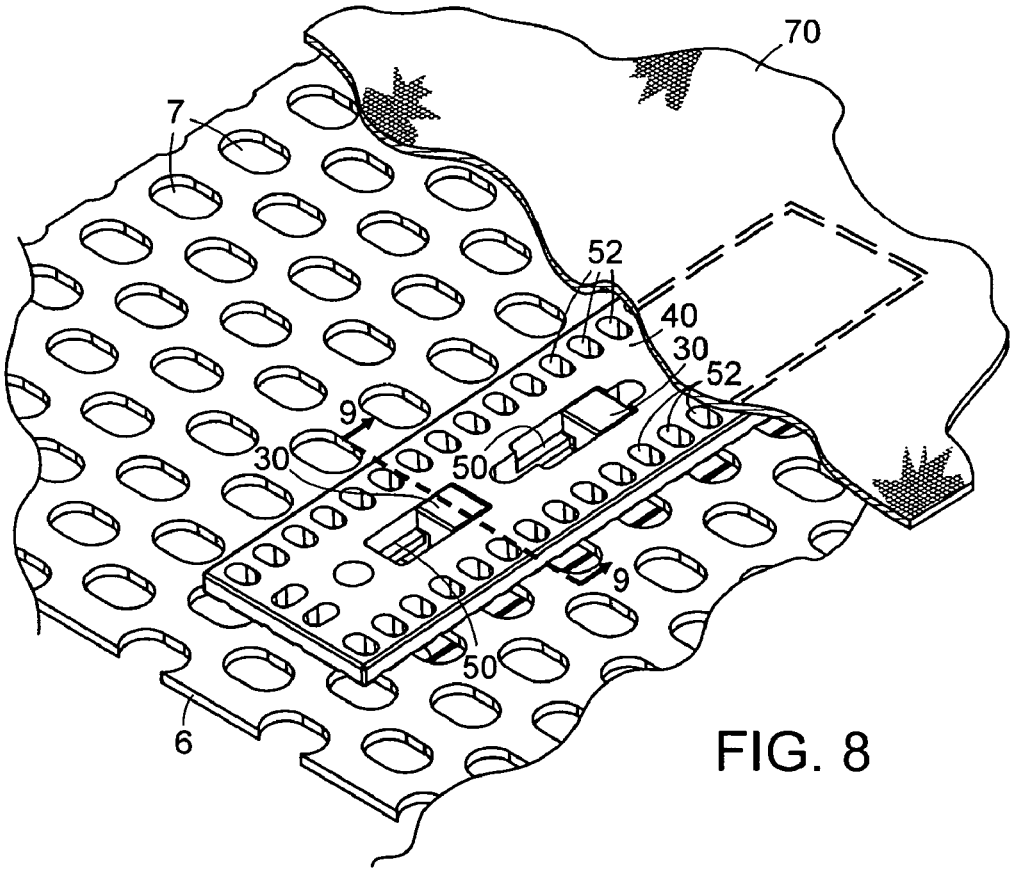
FIG. 8 is a perspective partially broken away view of the partially assembled components.

FIGS. 6 and 8 illustrate the components of FIG. 5 at an intermediate stage in their assembly. The base plate 40 and the locking plate 10 have been closed onto the meshed fabric, with the studs 26 of the locking plate projecting through the respective first openings 7 of the meshed fabric 6 and into the second openings 46 of the base plates. At this stage, the heads 30 of the studs 26 remain clear of the side ledges 50 bordering the slots 48.

Figure 4:
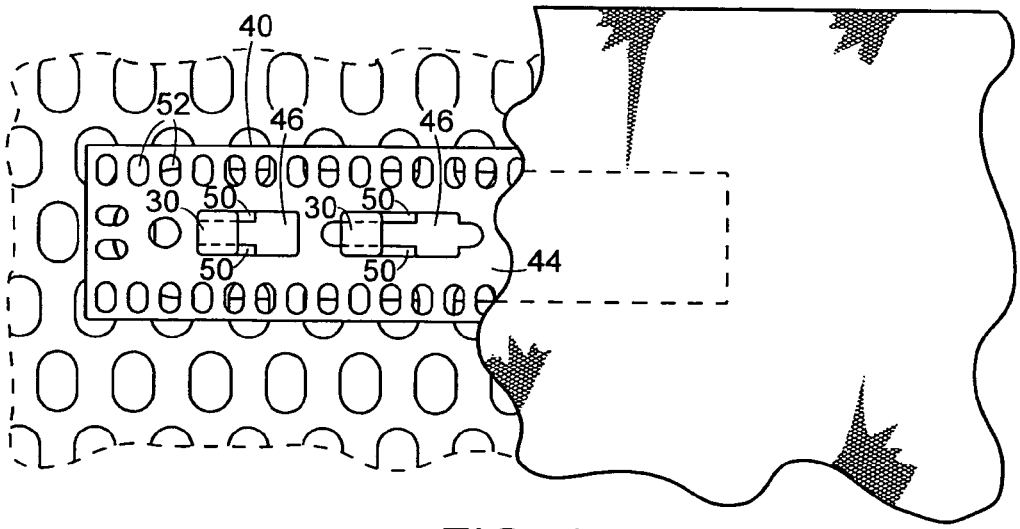
FIG. 4 is a partial cutaway view of an accessory attached by stitching to a base plate and a mesh fabric captured between the interlocked base plate and locking plate.
Figure 9:
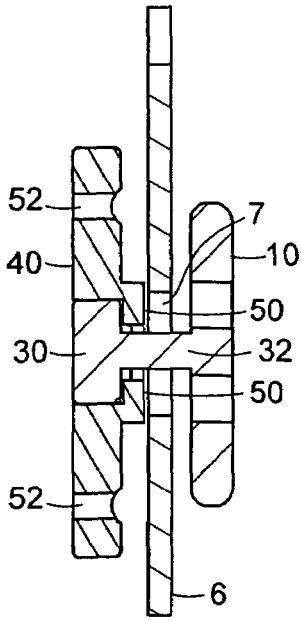
FIG. 9 is a sectional view on an enlarged scale taken along line 9-9 of FIG. 8.
Figure 7:
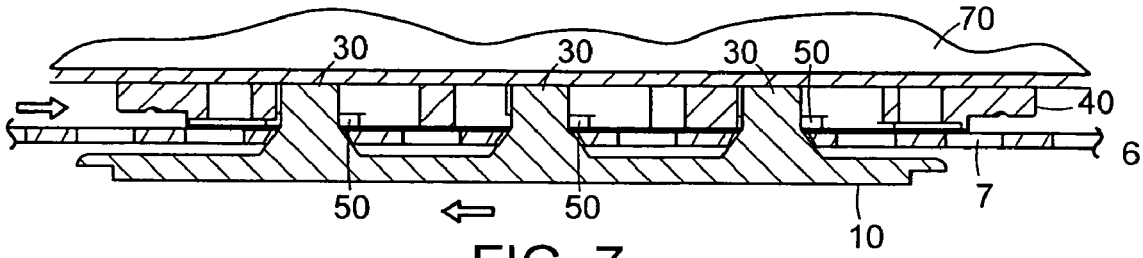
FIG. 7 is a view similar to FIG. 6 showing the components in a fully assembled and interlocked state.

FIGS. 4, 7, and 9 illustrate the final assembly stage, where the base plate 40 and locking plate 10 have been shifted with respect to each other to place the heads 30 of the studs 26 within the slots 48 in an overlapping and thus interlocked relationship with the side ledges 50.

Figure 10:
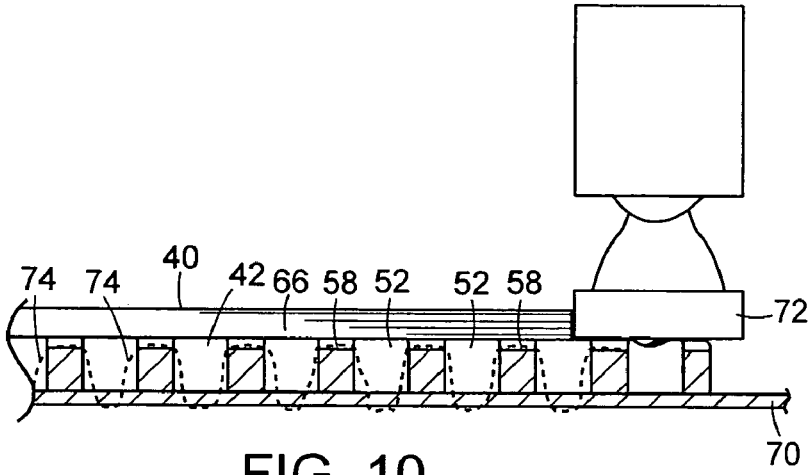
FIG. 10 depicts the stitching of the base plate to an accessory component.

FIG. 10 illustrates the stitching of the base plate 40 to the accessory component 70. The foot 72 of a sewing machine is guided by guide shoulder 66, with the stitches 74 being recessed beneath the top surface 42 in the grooves 58 between the holes 52.

Figure 11:
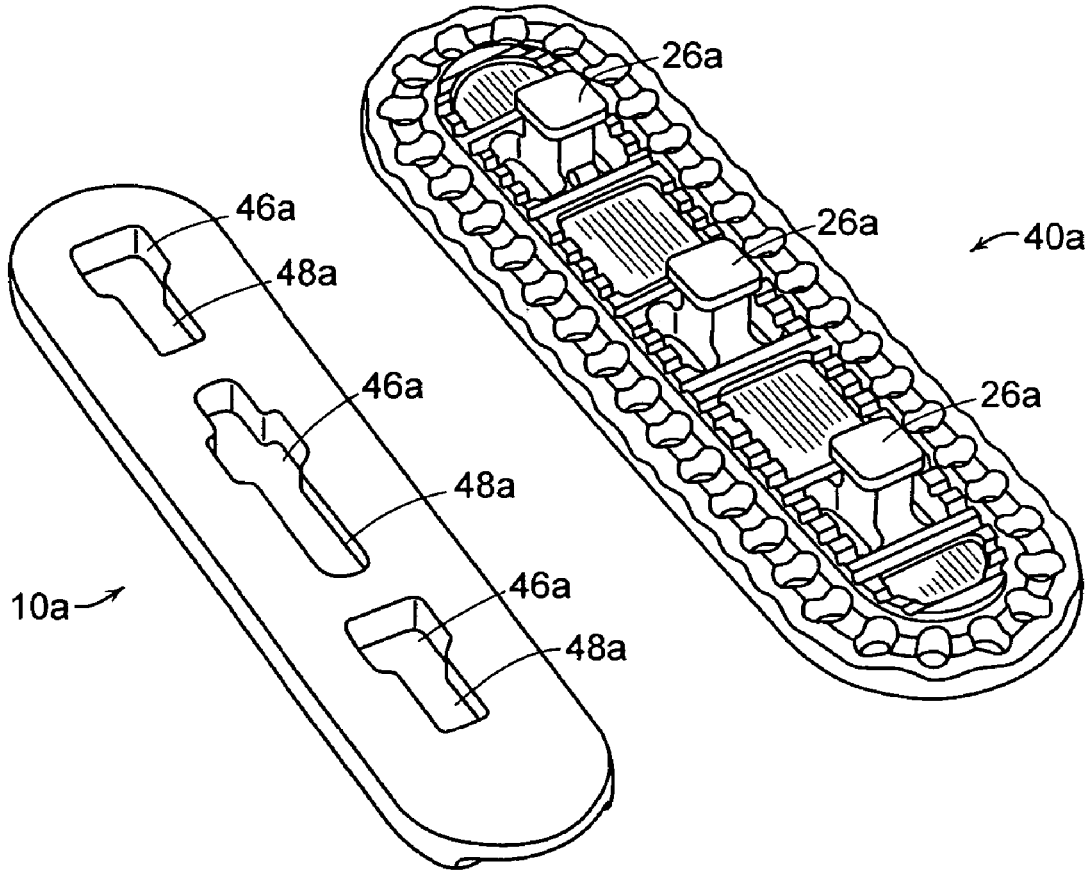
FIG. 11 is a perspective view of alternative embodiments of the base plate and locking plate.

FIG. 11 illustrates alternative embodiments of a locking plate 10*a* and a base plate 40*a*. These differ from the previously described base and locking plates 10, 40 in one major respect, that being that the studs 26*a* are arranged on the base plate 40*a*, and the second openings 46*a* and their associated slots 48*a* are located on the locking plate 10*a*. The locking plate 10*a* and the base plate 40*a* coact in interlocked engagement with the meshed fabric 6 in essentially the same way as described previously with respect to the locking plate 10 and base plate 40.

The foregoing description has been limited to a specific embodiment of the invention. It will be apparent, however, that variations and modifications can be made to the invention, with the attainment of some or all of the advantages of the invention. Therefore, it is the object of the appended claims to cover all such variations and modifications as come within the true spirit and scope of the invention.

We claim:

1. A modular assembly for detachable securing an accessory component to a garment or a harness, comprising:

a meshed fabric forming an integral part of said garment, said meshed fabric having an array of first openings;

a base plate and a locking plate;

means for securing said base plate to said accessory component, wherein said accessory component is comprised at least partially of a fabric to which said base plate is secured by stitching;

a plurality of studs on one of said plates; and a plurality of second openings on the other of said plates, said plates being adapted to be positioned on opposite sides of said fabric, with the studs on the said one plate projecting through respective first openings in said fabric and into interlocked engagement within the second openings of said other plate.

2. The modular assembly of claim 1, wherein said base plate is provided with third openings spaced along paths parallel to and on opposite sides of its a longitudinal axis, said third openings being arranged to accept a threaded needle of a sewing machine employed to stitch said base plate to said fabric.

3. The modular assembly of claim 2, wherein said base plate is additionally provided with guide surfaces for guiding said sewing machine along said paths.

4. The modular assembly of claim 1 wherein said second openings are spaced along the longitudinal axis of said base plate, and said studs are spaced along the longitudinal axis of said locking plate.

5. The modular assembly of claim 1, wherein said second openings are spaced along the longitudinal axis of said locking plate, and said studs are spaced along the longitudinal axis of said base plate.

6. The modular assembly of claim 1, wherein said second openings comprise undercut elongated slots communicating with apertures that are relatively large in comparison to the width of said slots, and wherein said studs have heads that are connected to the said one plate by stems, said heads being wider that said slots and being configured and dimensioned to enter said apertures in a first direction, and said stems having widths that are narrower than said heads and dimensioned to enter said slots in a second direction perpendicular to said first direction to position said heads beneath said slots and to establish said interlocked engagement.

7. The modular assembly of claim 4, wherein said studs comprise heads joined to said locking plate by stems, said stems being located between gaps in said locking plate.

8. The modular assembly of claim 7 wherein said heads have shoulders overlaying said gaps.

9. The modular assembly of claim 2 wherein a top surface of said base plate is provided with grooves extending between said third openings, and wherein said stitching is recessed beneath said top surface in said grooves.

10. The modular assembly of claim 4 wherein said base plate has a top surface with a raised longitudinally extending central area, and wherein said second openings are spaced along said central area.

11. The modular assembly of claim 1, wherein said means for securing said base plate to said accessory component comprises openings formed in said base plate to accommodate riveting.

12. A modular assembly for detachably securing an accessory component to a garment or a harness, said apparatus comprising:

a meshed fabric forming an integral part of said garment, said meshed fabric having an array of first openings;

a base plate having a plurality of second openings spaced along a longitudinal axis of said base plate, said base plate being adapted to be positioned on one side of said meshed fabric with said second openings aligned with mating first openings, third openings in said base plate spaced along paths parallel to and on opposite sides of said longitudinal axis, said third openings being arranged to accept a threaded needle of a sewing machine employed to stitch said base plate to said fabric;

means for securing said base plate to said accessory component, wherein said accessory component is comprised at least partially of a fabric to which said base plate is secured by stitching, and a locking plate having a plurality of studs, said locking plate being adapted to be positioned on an opposite side of said meshed fabric with said studs projecting through said mating first openings into said second openings and slid into interlocked engagement with said base plate.

13. The modular assembly of claim 12, wherein said base plate is additionally provided with guide surfaces for guiding said sewing machine along said paths.

14. The modular assembly of claim 12, wherein said second openings comprise undercut elongated slots communicating with apertures that are relatively large in comparison to the width of said slots, and wherein said studs have heads that are connected to said base plate by stems, said heads being wider than said slots and being configured and dimensioned to enter said apertures in a first direction, and said stems having widths that are narrower than said heads and dimensioned to enter said slots in a second direction perpendicular to said first direction to position said heads beneath said slots and to establish said interlocked engagement.

15. The modular assembly of claim 12, wherein said studs comprise heads joined to said base plate by stems, said stems being located between gaps in said base plate.

16. The modular assembly of claim 15 wherein said heads have shoulders overlaying said gaps.

17. The modular assembly of claim 12 wherein a top surface of said base plate is provided with grooves extending between said third openings, and wherein said stitching is recessed beneath said top surface in said grooves.

18. The modular assembly of claim 12 wherein said base plate has a top surface with a raised longitudinally extending central area, and wherein said second openings are spaced along said central area.

19. A modular assembly for detachably securing an accessory component to a garment or a harness, comprising:

a meshed fabric forming an integral part of said garments, said meshed fabric having an array of first openings;

a locking plate having a plurality of second openings spaced along a longitudinal axis of said locking plate;

a base plate having a plurality of studs spaced along a longitudinal axis of said base plate, said base plate being additionally provided with third openings spaced along paths parallel to and on opposite sides of said longitudinal axis, said third openings being arranged to accept a threaded needle of a sewing machine employed to stitch said base plate to said accessory component, said base plate being adapted to be positioned on one side of said meshed fabric with said studs protruding through respective first openings, and said locking plate being adapted to be positioned on an opposite side of said meshed fabric with said studs received in said second openings in interlocked engagement with said locking plate.

20. The modular assembly of claim 19, wherein said base plate is additionally provided with guide surfaces for guiding said sewing machine along said paths.

21. The modular assembly of claim 19, wherein said second openings comprise undercut elongated slots communicating with apertures that are relatively large in comparison to the width of said slots, and wherein said studs have heads that are connected to said locking plate by stems, said heads being wider than said slots and being configured and dimensioned to enter said apertures in a first direction, and said stems having widths that are narrower than said heads and dimensioned to enter said slots in a second direction perpendicular to said first direction to position said heads beneath said slots and to establish said interlocked engagement.

22. The modular assembly of claim 19, wherein said studs comprise heads joined to said base plate by stems, said stems being located between gaps in said locking plate.

23. The modular assembly of claim 22 wherein said heads have shoulders overlaying said gaps.

24. The modular assembly of claim 19 wherein a top surface of said base plate is provided with grooves extending between said third openings, and wherein said stitching is recessed beneath said top surface in said grooves.

25. A modular assembly for detachable securing an accessory component to a garment or a harness, comprising:

a meshed fabric forming an integral part of said garment, said meshed fabric having an array of first openings;

a base plate and a locking plate;

means for securing said base plate to said accessory component;

a plurality of studs on one of said plates; and a plurality of second openings on the other of said plates, said plates being adapted to be positioned on opposite sides of said fabric, with the studs on the said one plate projecting through respective first openings in said fabric and into interlocked engagement within the second openings of said other plate;

wherein said second openings comprise undercut elongated slots communicating with apertures that are relatively large in comparison to the width of said slots, and wherein said studs have heads that are connected to the said one plate by stems, said heads being wider that said slots and being configured and dimensioned to enter said apertures in a first direction, and said stems having widths that are narrower than said heads and dimensioned to enter said slots in a second direction perpendicular to said first direction to position said heads beneath said slots and to establish said interlocked engagement.

26. A modular assembly for detachable securing an accessory component to a garment or a harness, comprising:

a meshed fabric forming an integral part of said garment, said meshed fabric having an array of first openings;

a base plate and a locking plate;

means for securing said base plate to said accessory component, wherein said means for securing said base plate to said accessory component comprises openings formed in said base plate to accommodate riveting;

a plurality of studs on one of said plates; and a plurality of second openings on the other of said plates, said plates being adapted to be positioned on opposite sides of said fabric, with the studs on the said one plate projecting through respective first openings in said fabric and into interlocked engagement within the second openings of said other plate; wherein said second openings comprise undercut elongated slots communicating with apertures that are relatively large in comparison to the width of said slots, and wherein said studs have heads that are connected to said one plate by stems, said heads being wider than said slots and being configured and dimensioned to enter said apertures in a first direction.

* * * * *